US005280879A

United States Patent [19]

Kreuter

[11] Patent Number: 5,280,879

[45] Date of Patent: Jan. 25, 1994

[54] CAPSTAN WINCH WITH FIXED INTERNALLY GROOVED SLEEVE

[76] Inventor: Kenneth G. Kreuter, P.O. Box 809, Osage Beach, Mo. 65065

[21] Appl. No.: 816,154

[22] Filed: Dec. 31, 1991

[51] Int. Cl.[5] ..... B66D 1/36

[52] U.S. Cl. ..... 254/333; 254/383

[58] Field of Search ..... 254/216, 225, 271, 333, 254/371, 373, 383, 338; 242/54 R, 54 A, 117

[56] References Cited

U.S. PATENT DOCUMENTS

| | | | |
|---|---|---|---|
| 1,536,383 | 5/1925 | French | 254/373 |
| 2,976,017 | 3/1961 | Le Bus | 254/333 |
| 3,048,370 | 8/1962 | Kratzer | 254/333 X |
| 3,448,962 | 6/1969 | Miller | 254/333 X |
| 3,807,697 | 4/1974 | Cotreau et al. | 254/383 X |
| 3,843,094 | 10/1974 | Watts | 254/333 |
| 3,887,164 | 6/1975 | Coombs | 254/333 X |
| 4,953,829 | 9/1990 | Knaack et al. | 254/333 |

FOREIGN PATENT DOCUMENTS

| | | | |
|---|---|---|---|
| 0336739 | 2/1920 | Fed. Rep. of Germany | 254/333 |
| 0471294 | 8/1975 | U.S.S.R. | 254/333 |
| 0641821 | 8/1950 | United Kingdom | 254/333 |

*Primary Examiner*—Clifford D. Crowder
*Assistant Examiner*—Ismael Izaguirre

[57] ABSTRACT

A winch for moving loads with a continuous cable over varying distances that consists of a winch drum (10) with a fixed sleeve (26) to maintain proper laydown and separation of cable (34) on the drum (10). The sleeve (26) is helically grooved on its interior surface to form a space for the winch cable (34) to be guided therein. Pull force is mostly the result of the tension adjusted on the endless cable, the friction between the cable (34) and drum (10), the diameter of the drum, and the number of turns of cable (34) on the drum (10). The number of turns of cable (34) on the drum (10) is determined by the length of the drum (10) and sleeve (26) and the number of grooves machined into the sleeve's interior surface.

9 Claims, 6 Drawing Sheets

CAPSTAN WINCH WITH FIXED INTERNALLY GROOVED SLEEVE

BACKGROUND

1. Field of Invention

This invention relates to winches, specifically to an improved winch that acts upon a load on a cable without causing a buildup of cable on the winch drum.

2. Description of Prior Art

Heretofore, the most common method of winch construction has been one which employs a smooth drum surface and a fixed cable length, one end of which was attached to the winch drum.

The cable may feed haphazardly onto the drum or may be guided by a geared mechanism which causes the cable to be laid somewhat evenly over the surface of the drum. Most winches of this type operate on a fixed length of cable. The distance that a load can be moved is limited by the length of cable that can be stored on the drum. In the case that loads must be moved over long distances, the drum of the aforementioned winch must be made quite large to accommodate the cable.

Some winches heretofore have used only a single layer of wound cable with one end attached to a load and the other end placed under tension. Winches for a sailboat are of this type.

OBJECTS AND ADVANTAGES

Accordingly, several objects and advantages of this invention are:

(a) to provide a compact winch of simple design that is inexpensive, and is not required to increase in size as the distance to the load and consequently the length of cable increases;

(b) to provide a simple arrangement to keep the cable spaced evenly across the drum surface;

(c) the ability to move a range of loads with the winch of this invention by varying some design features such as tailing force and the number of turns of cable on the drum; and (d) the inclusion of an inherent safety factor whereby cable slippage occurs when the predetermined load capacity of the winch is exceeded.

DRAWING FIGURES

REFERENCE NUMERALS IN DRAWINGS

Figure 1:
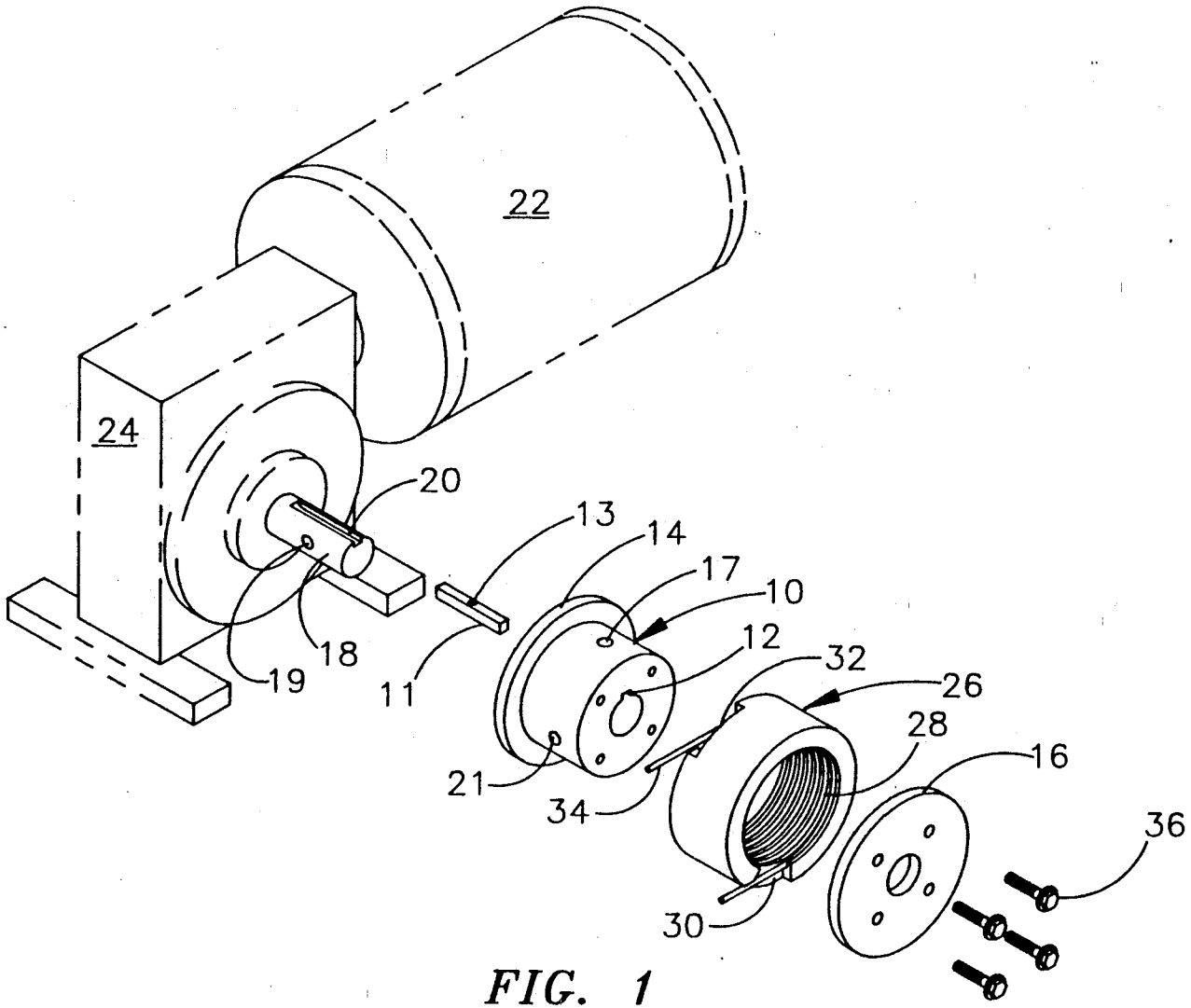
FIG. 1 depicts an exploded view of the winch, including the motor, gear reduction unit, shaft, drum and internally grooved sleeve.

10: drum
11: key

12: drum keyway
13: threaded hole in key
14: inner or first flange
16: outer or second flange
17: threaded hole for set screw to key
18: shaft
19: threaded hole in shaft
20: shaft keyway
21: threaded hole for set screw to shaft
22: motor
24: gear reducer
26: sleeve
28: square-thread groove
30: outer notch
31: outer notch lead in
32: inner notch
33: inner notch lead in
34: cable
36: bolt
37: threaded hole
38: non-rotation lugs
39: slot
40: tensioner spring
**40*a***: second tensioner spring
41: mounting pin
42: tensioner pulley
**42*a***: second tensioner pulley
43: mounting base
44: fixed or turning pulley
**44*a***: second fixed or turning pulley
46: winch housing
48: cart or load
50: track
52: cable-return pulleys
54: solid stop on spring travel
**54*a***: second solid stop on spring travel
56: outer side of winch
58: inner side of winch.

DESCRIPTION—FIGS. 1 to 6

An exploded view of the winch of this invention together with a power source is shown in FIG. 1. The winch consists of a smooth drum 10 with a drum keyway 12 machined along the length of its bore or inner diameter. The drum keyway is the preferred means of coupling the winch to a power source but numerous other ways will be obvious to one skilled in the art. The drum 10 is typically constructed of cast iron with a smooth exterior surface. An inner or first flange 14 is machined, cast or molded as an integral part of the drum 10 or it may be fastened thereto.

The drum is aligned to the shaft 18 of a gear reducer 24 by mating the drum keyway 12 to the shaft keyway 20 and inserting key 11. The drum 10 is locked to the key 11 by a set screw inserted through the threaded hole for set screw to key 17. The drum 10 is also locked to the shaft 18 by a set screw inserted through the threaded hole for set screw to shaft 21 and into the threaded hole in shaft 19.

The gear reducer 24 is geared to provide approximately 100 revolutions per minute in the example shown at the constant speed of the AC motor 22. The motor or power source and gear reducer are readily available from numerous sources.

A sleeve 26 is depicted with square-thread grooves 28 machined in a helical fashion into its internal surface. The square-thread grooves 28 are typically 0.140 inches wide by (3.5 millimeters) 0.140 inches deep, or large enough to accommodate the 0.125 inch diameter stainless steel cable 34 that is threaded along the length of the square-thread grooves 28. The sleeve 26 is typically constructed of porous bronze material.

An outer or second notch 30 provides one point of access for the cable 34 to enter or exit one end of the square-thread groove 28. The inner or first notch 32 provides a second point of access for the cable 34 to enter or exit the other end of the square-thread groove 28.

Four bolts 36 are employed to attach the outer or second flange 16 to the drum 10 and thereby hold the sleeve 26 securely on the drum 10 and preclude any substantial axial movement of one with respect to the other.

Figure 2:
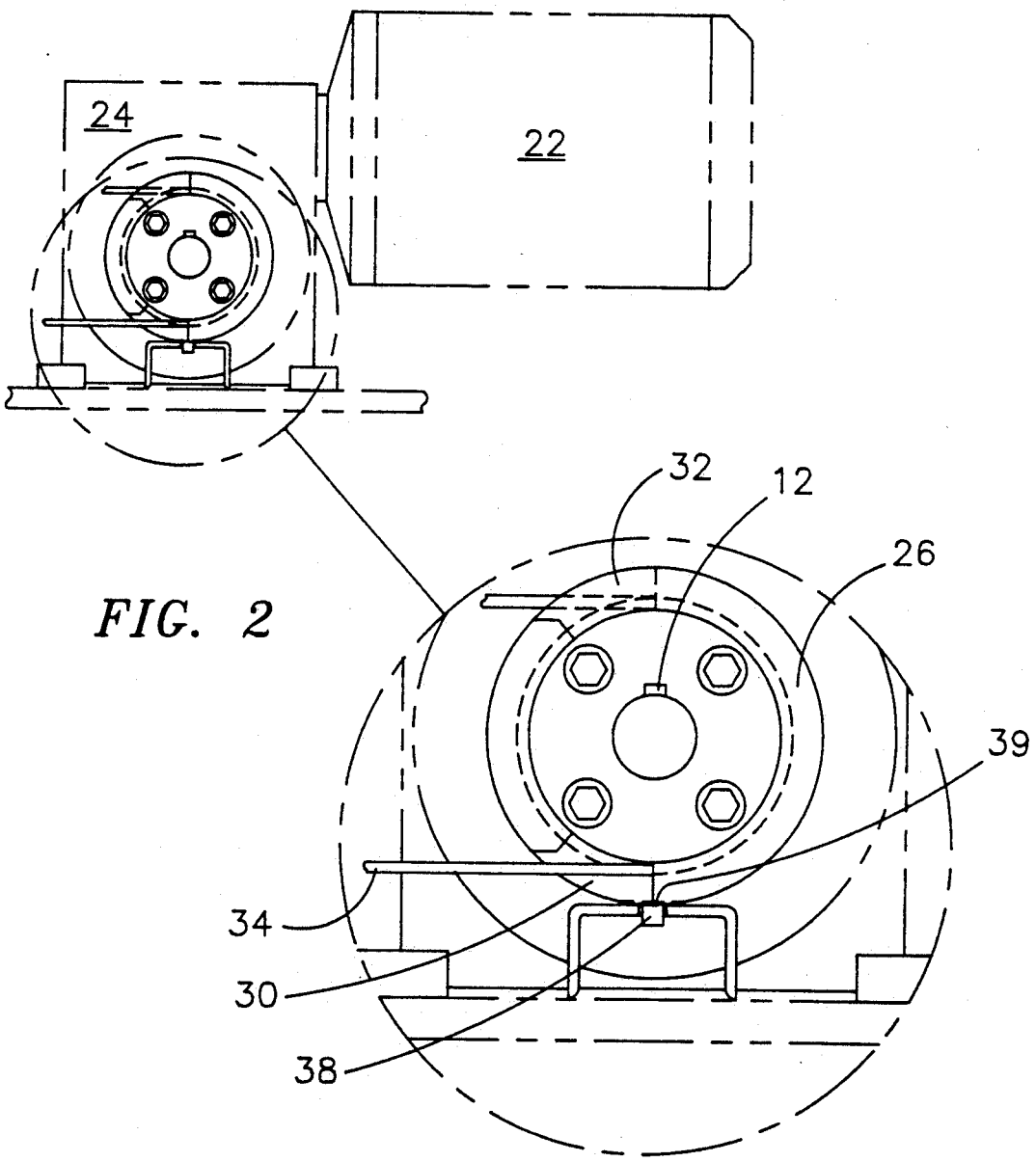
FIG. 2 is a detail drawing of the winch showing the engagement of the non-rotation lugs and the manner in which the cable feeds into the notches in the internally grooved sleeve.

A detail drawing of the winch is shown in FIG. 2. The overall view depicts the motor 22 and gear reducer 24 in relation to the winch drum 10.

The enlarged close-up view depicts an end view of the drum keyway 12. The cable 34 is shown in relation to the outer notch 30 and inner notch 32.

The outer flange 16 holds the sleeve 26 on the drum 10. Two non-rotation lugs 38 are attached to the sleeve and slidingly fit into a slot 39 in the metal frame or mounting base 43 beneath the sleeve 26 and prevent the sleeve from turning with the drum. Thus, this forms an antirotation arrangement for said sleeve.

Figure 3:
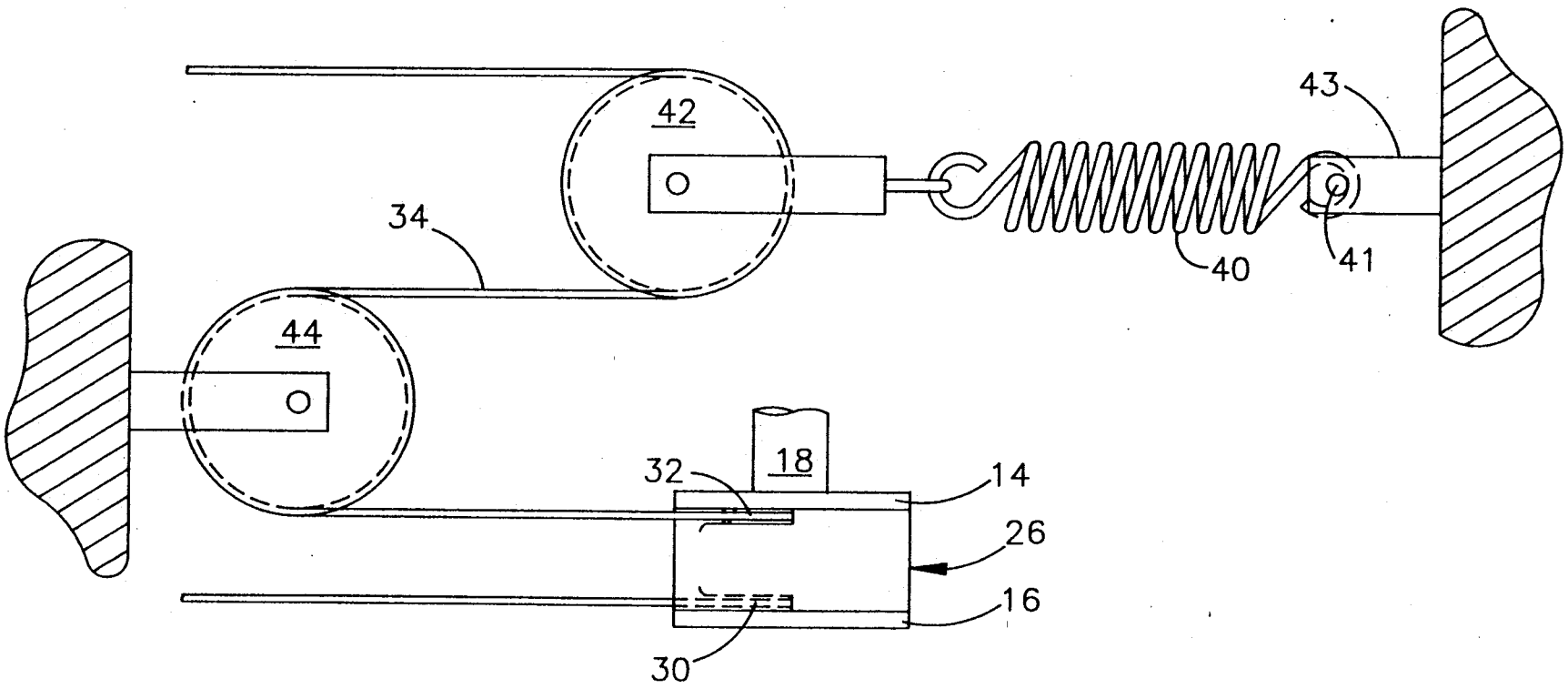
FIG. 3 depicts the winch drum in relation to the fixed pulley, the tensioner pulley, and the tensioner spring.

FIG. 3 depicts the winch sleeve 26 in relation to the fixed pulley 44, the tensioner pulley 42, and the tensioner spring 40. The tensioner spring 40 provides a tailing force that creates friction between the cable 34 and smooth drum surface, thereby allowing the winch to move a load. The tension of tensioner spring 40 is adjustable by either changing the spring or moving the position of its mounting pin 41 either by putting it on an adjustable screw or changing the length of mount 43.

The cable 34, typically 0.125 inch (3.125 millimeters) diameter stainless steel aircraft cable with a tensile strength of 2000 pounds (90.9 kilograms), is shown entering the outer notch 30 and exiting the inner notch 32. This cable 34 is then routed around the fixed pulley 44 and the tensioner pulley 42. The shaft 18, inner flange 14 and outer flange 16 are also depicted.

Figure 4:
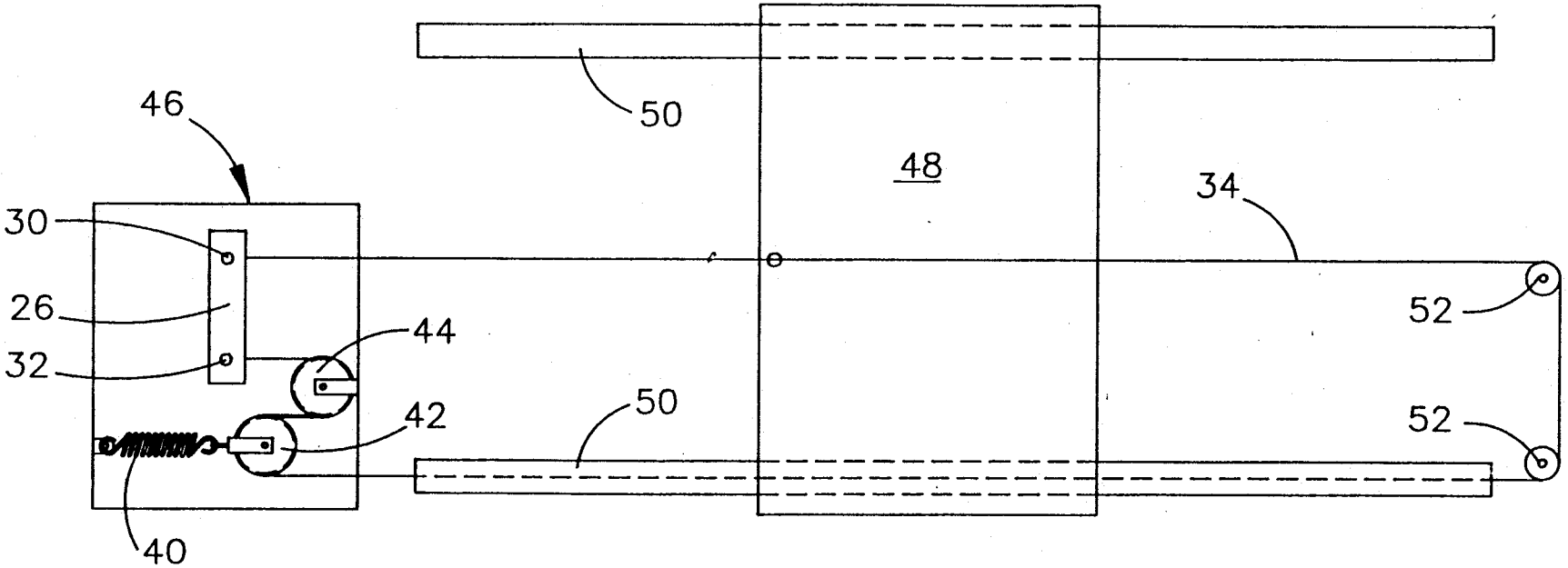
FIG. 4 is a schematic diagram of the general layout of a typical system including the winch housing, cart, cart tracks, cable, and cable return pulleys.

A typical overall system is schematically shown in FIG. 4. The winch housing 46 is shown with the cable 34 entering and exiting the housing in two locations. The cable is continuous and is terminated at the cart or load 48.

As used in this specification, "continuous cable" means that the cable pulled by the winch of the invention has indeterminate ends as neither end is attached to the winch. "Cable" as used herein includes any line or strand, such as steel aircraft cable, synthetic plastic or fiber rope, and similar materials capable of pulling a load.

The cable 34 exits the winch housing 46 after passing around the tensioner pulley 42 and runs through the track 50. Tracks in this case are heat formed polyvinyl chloride (PVC) piping. Two cable-return pulleys 52 turn the cable 34 around 180 degrees and guide it down the center section of the track 50. The two ends of the cable 34 are terminated and fastened to the cart or load 48.

The specific application does not form part of this invention and is merely representative of many uses to which the invention can be applied. The winch, instead of being stationary, could be on the load itself and carry the load along a single strand of cable. Also the winch could be stationary and pull the cable in one direction provided tailing tension is maintained on the cable such as by a take-up reel.

Figure 5:
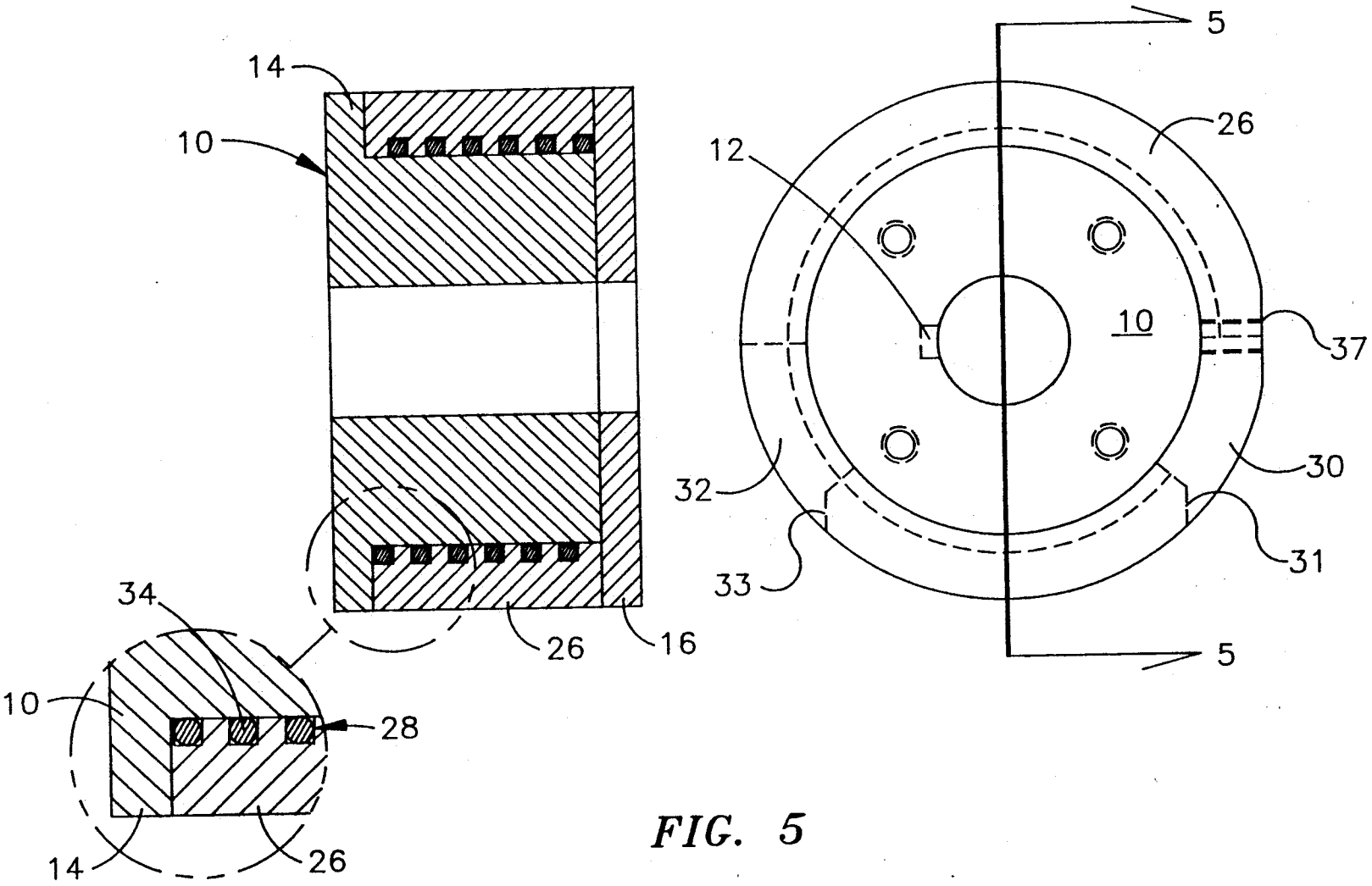
FIG. 5 is a detail drawing of the drum and sleeve of the winch including the details of the cable as it travels through the square thread grooves.

FIG. 5 shows a detail drawing of the drum 10 and sleeve 26 along with details of the outer notch 30 and inner notch 32.

The inner flange 14 is depicted as an integral part of the drum 10. The outer flange 16 is fastened to the drum 10 by four bolts.

A sleeve 26 is shown with the square-thread groove 28 machined on its interior surface. A cutaway view of the sleeve 26 shows the cable 34 after it has been threaded through the square-thread groove 28.

The clearance between sleeve 26 and drum 10 is sufficient to permit free rotation with respect to one another. The sleeve preferably extends entirely around drum 10 but could extend part way as long as it was sufficient to hold the cable in a single spaced layer on the drum. The groove is helically disposed and is of a width and depth sufficient to readily accommodate the width and depth or diameter of the cable and maintain it in a single layer helically coiled about the drum with a uniform spacing between the individual turns. The sleeve serves to hold the cable in proper position on the drum and move it across the drum as it turns.

With reference to FIG. 5, there are shown threaded holes 37 in sleeve 26 into which non-rotation lugs 38 are threaded in order to serve as anti-rotation devices. FIG. 5 is broken into three digures with the middle figure being a cross-section of the right figure along section 5—5. The left figure is a blow-up of part of the middle figure to better show the relationship between the cable, drum and sleeve. It is to be noted that outer notch 30 and inner notch 32 are cut into the sleeve in front of the lead to the first and last internal thread so the cable can pass directly to the spool between the thread and drum without interference. As shown, preferably the cable enters and exits the winch at tangents to the drum 180 degrees from each other but on the same side which is the bottom of FIG. 5. The notches have lead-ins 31 and 33 which are flat sections that are located approximately on or inside the tangents to the smooth surface of drum 10.

Figure 6:
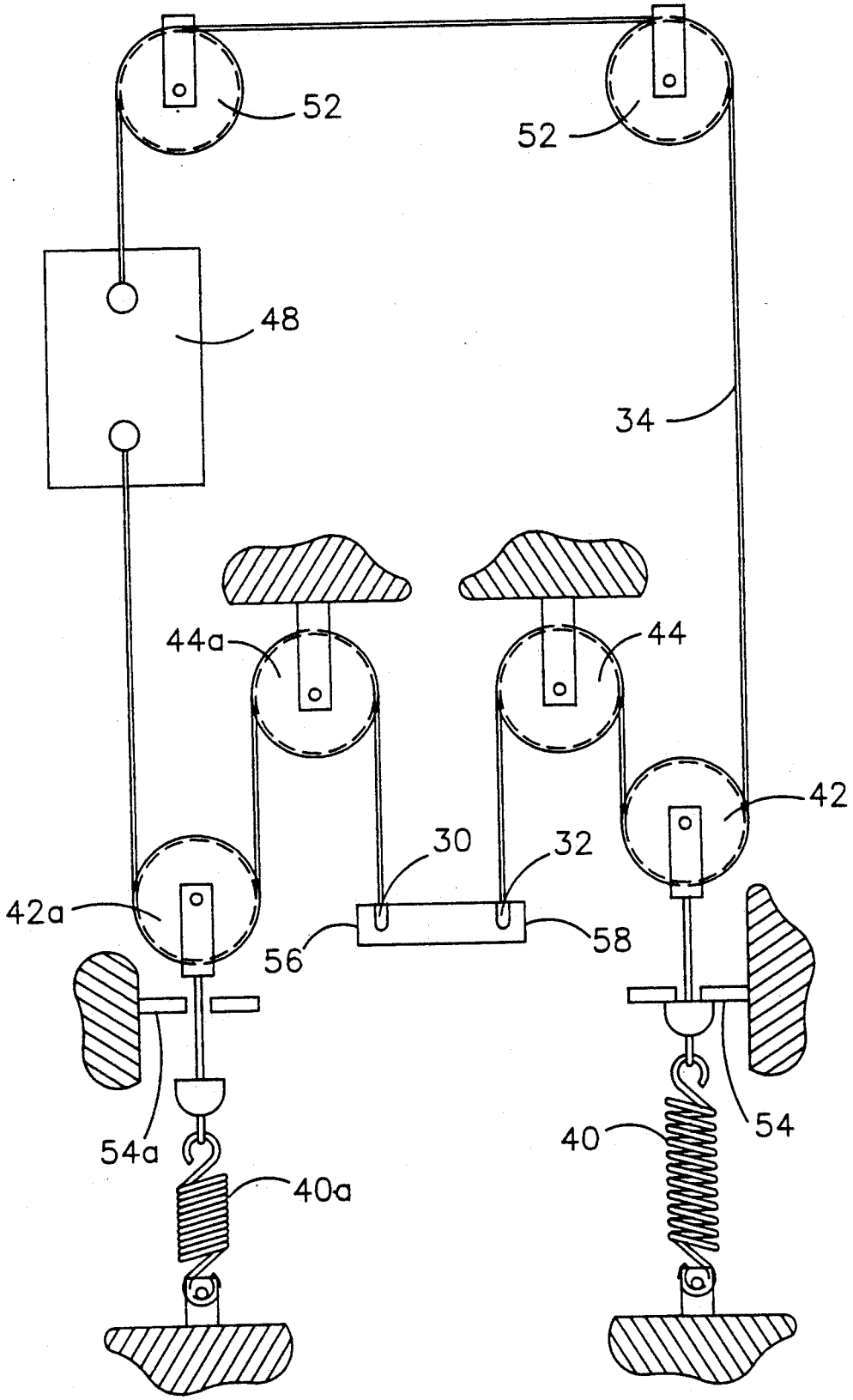
FIG. 6 depicts a winch arrangement that may be used to move a load in two directions.

FIG. 6 depicts a winch arrangement that may be used to move a load in two directions. In addition to the winch of FIG. 4 that can be used to move a load in one direction, there are included on the depicted outer side of the winch 56 a second tensioner spring **40*a*, a second tensioner pulley 42*a*, and a second fixed or turning pulley 44*a*. In addition, this winch of FIG. 6 that will move a load in two directions contains a solid stop on spring travel 54 on the inner side of the winch 58 and a second solid stop on spring travel 54*a* on the outer side of the winch 56**.

OPERATION—FIGS. 1 THROUGH 6

The winch of this invention is typically used for an endless cable which is attached to a load that moves with the cable. A specific example is a small vehicle for carrying passengers and materials up a steep terrain of a lakefront lot.

The winch arrangement, shown in FIG. 1, consists of a smooth surface drum 10 that is keyed to the shaft 18 of a gear reducer 24. The gear reducer 24 is connected to an AC motor 22 that is wired to run in either direction. Direction is reversed by pushing one of two pushbutton switches (not shown), which reverse the current to the AC motor 22 thereby causing a change of direction.

The motor 22 and gear reducer 24 are designed to provide 100 revolutions per minute to the gear reducer shaft 18 and thus to the drum 10 in the example shown. This can be varied with the circumstances.

To operate the unit, the drum 10 is first keyed to the shaft 18 of the gear reducer 24 by aligning the drum keyway 12 and shaft keyway 20. The key 11 is inserted into the keyway and a set screw is inserted through the threaded hole for set screw to key 17 and into the threaded hole in key 13 to lock the drum 10 to the key 11. The drum 10 is also locked to the shaft 18 by a set screw inserted through the threaded hole for set screw to shaft 21 and into the threaded hole in the shaft 19. The cable 34 must then be fed into the sleeve 26 as it is slipped onto the drum 10.

The sleeve 26 consists of a cylindrical piece of metal, typically constructed of porous bronze material that is machined to the shape of a ring. Square-thread grooves 28, typically 0.140 inches (3.5 millimeters) deep by 0.140 inches (3.125 millimeters) wide are cut helically into the internal circular surface of the sleeve 26. Notches are cut at each edge of the sleeve 26 to allow access points for the 0.125 inch (3.125 millimeters) diameter cable 34. The square-thread grooves 28 are cut to provide five and one-half turns of the cable 34 on the drum 10.

An inner flange 14 is machined as an integral part of the drum 10. Typical diameter of the drum 10 is 3.0 inches. At the 100 revolution per minute speed imposed by the motor 22 and gear reducer 24, the drum 10 will impart a speed of 1.3 feet per second to the cable 34.

In practice, one end of cable 34 is routed into one of the notches in the sleeve. With the sleeve 26 off of the drum 10, an end of the cable 34 would typically be routed into the inner notch 32. The tension and stiffness of the typically 0.125 inch diameter stainless steel cable 34 would cause it to follow the inner contour of the square-thread grooves 28 as it is fed into the sleeve 26. The cable 34 would exit the sleeve 26 through the outer notch 30.

After being threaded with the cable 34, the sleeve 26 is slipped onto the winch drum 10 that has been aligned with a key 11 and attached by set screws to the key 11 and shaft 18 of the gear reducer 24. The sleeve 26 slides onto the drum 10 until it contacts the inner flange 14.

Referring to FIG. 2, as the sleeve 26 is slid onto the drum 10, two bolts that serve as non-rotation lugs 38 slide into a slot 39 mounted in framework or on the base beneath the sleeve 26. The non-rotation lugs 38 prevent the sleeve 26 from turning with the drum 10 as the winch is operated.

Referring again to FIG. 1, the outer flange 16 is then mated to the drum 10 using four bolts 36. The outer flange 16 secures the sleeve 26 on the drum 10 and prevents the non-rotation lugs 38 from slipping out of the slot 39.

The free end of the cable 34 that has been threaded through the sleeve 26 is then connected to the load 48 as shown in FIG. 4. The cable 34 will therefore make a continuous loop from the load 48 to the cable-return pulleys 52, to the tensioner pulley 42, around the fixed pulley 44, through the sleeve 26 and around the drum 10, and back to the load 48.

When the end of the cable 34 that has been threaded through the sleeve 26 is attached to the load 48, the slack in the cable 34 is taken up to adjust the tailing force applied to the tensioner pulley 42. The tensioner spring 40, attached to the tensioner pulley 42, allows small variations in the tension on the cable 34 as the winch is operated to move the load 48.

Cable tension is set by adjusting the cable length until the proper tailing force is reached. The amount of load the winch will pull is dependent on the number of square-thread grooves 28 cut in the sleeve 26, the coefficient of friction between the cable 34 and the drum 10 surface, the diameter of the drum; and the tailing force or tension put on the cable 34. With a load measuring device installed between the tensioner spring 40 and the tensioner pulley 42, a tailing force of 5 pounds (2.3 kilograms) enabled the movement of a 200 pound (90.9 kilograms) load on the cart. The ratio of pulling force to tailing force is therefore 40 to 1 in this arrangement.

As shown in FIG. 4, the cable 34 is routed from the outer notch 30 in the sleeve 26 through the middle of the tracks 50. This end of the cable 34 may be called the pull cable as it is acted on by the winch to pull the load.

The other end of the cable 34 may be referred to as the return cable. It returns cable 34 to the winch drum 10 through the inner notch 32. The return cable is routed from the load, around the two cable-return pulleys 52, and then through one of the PVC tracks 50. After exiting the track 50, the return cable first goes around the tensioner pulley 42, then the fixed pulley 44, and finally returns to the drum 10. Although the terminology refers to the pull cable and return cable, this is just for ease of explanation and it therefore must be realized that the cable 34 is continuous through the drum 10 and sleeve 26 arrangement and that both ends terminate at the load 48.

When the motor is reversed, the empty cart may be sent away from the winch. In this manner, the cart may be moved from the end nearest the winch housing 46 to the other end. The winch of this arrangement can only be used to move a load 48 in one direction, towards the winch. The cart can however, be moved back to the other end of the track by reversing the direction of the AC motor.

FIG. 3 illustrates the arrangement of the winch in relation to the fixed pulley 44, tensioner pulley 42, and tensioner spring 40. When preparing the system for operation, the slack is taken up in cable 34 until the desired tension is attained on tensioner spring 40. This becomes the tailing force and directly affects the load pulling capability of the winch. There is a 40 to 1 ratio between pulling force and tailing force, therefore, adjustment to a 5 pound (2.3 kilograms) tailing force on the tensioner pulley 42 will achieve a 200 pound (90.9 kilograms) pull force on cable 34.

Details of the square-thread grooves 28 are given in FIG. 5. The square-thread grooves 28, machined into the inside diameter of the sleeve 26, allow for an orderly and constant spacing of cable 34 across the drum 10.

The winch of this invention contains an inherent load limiting safety feature whereby the cable 34 will slip on the drum 10 if the load capacity of the winch is exceeded. If the load exceeds the load capacity as determined by the pull force to tailing force ratio, the friction between the cable 34 and drum 10 is not adequate to move the load and cable 34 slips on the drum 10.

FIG. 6 depicts a winch arrangement that may be used to pull a load in either of two directions. This winch would require a second turning pulley **44*a*, second tensioner pulley 42*a*, second tensioner spring 40*a*, and solid stop on spring travel on both ends of the winch. The ends of the winch are here designated the outer side of winch 56 and inner side of winch 58. A solid stop on spring travel 54 is shown on the inner side of the winch 58. A 54***a* solid stop on spring travel is shown on the outer side of the winch 56.

To pull a load 48 away from the winch, the AC motor would be run in such direction to cause cable 34 to feed into the inner notch 32 and out of the outer notch 30. In this case, the tensioner spring 40 on the inner side of the winch 58 would be extended to the solid stop on spring travel 54. The tailing cable, exiting outer notch 30, would have 5 pounds of tension as set by the tensioner spring 40*a* on the outer side of the winch 56. In this case tensioner spring 40*a* would be active and applying tailing force to the tailing end of the cable 34.

To move a load 48 in the opposite direction, toward the winch, AC motor 22 would be reversed to cause cable 34 to feed into the outer notch 30 and out of the inner notch 32. In this case, the tensioner spring 40*a* on the outer side of the winch 56 would be extended to the solid stop on spring travel 54*a*. The tailing cable, exiting notch 32, would have 5 pounds of tension as set by the tensioner spring 40 on the inner side of the winch 58. In this case tensioner spring 40 would be active and applying tailing force to the tailing end of the cable 34.

SUMMARY, RAMIFICATIONS AND SCOPE

Accordingly, the winch of this invention can be used to pull a load a great distance over uneven and varying terrain. In addition, the winch of this invention has the following additional advantages in that:

a) it is compact, simple, inexpensive, and is not required to increase in size as the distance to the load increases;

b) a simple arrangement is provided to keep the cable spaced evenly across the drum;

c) a wide range of loads may be moved by varying those factors which affect pulling force, such as tailing force and turns of cable on the drum; and d) a built in safety feature is provided whereby cable slippage on the drum occurs when the load capacity of the winch is exceeded.

Although the description above contains many specificities, these should not be construed as limiting the scope of this invention but as merely providing illustrations of some of the invention's many features. For example, the winch may have more or less turns of square-thread grooves, the grooves may be of shapes other than square and still perform the same function, the drum may be constructed of other materials to affect the coefficient of friction between the drum and cable, the winch may be set up to pull loads vertically, a larger diameter drum may be used, the sleeve may be moulded plastic, the cable may be rope, etc.

Thus the scope of the invention should be determined by the appended claims and their legal equivalents, rather than by the examples given.

What is claimed is:

1. A winch for a continuous cable comprising:

a winch drum having an arrangement for connecting to a source of power and a smooth cylindrical surface adapted to be in direct contact with a cable helically wound thereon;

a winch mounting base and source of power with said source of power operatively connected to said arrangement on said winch drum;

a cylindrical sleeve surrounding said winch drum with sufficient clearance to permit said winch drum to rotate in said sleeve and fixed so as to not move a substantially amount axially relative thereto;

an inner helical groove having two ends located on the inside of said cylindrical sleeve with said groove being of a depth and width to receive a cable wound on said winch drum;

a cable inlet and a cable outlet on said cylindrical sleeve leading to the ends of said inner helical groove;

flanges fixed at each end of said winch drum and rotating therewith which prevent any substantial axial movement of said cylindrical sleeve relative to said winch drum; and an anti-rotation arrangement on the side of said cylindrical sleeve to prevent said cylindrical sleeve from rotating when said winch drum is rotating.

2. The winch of claim 1 wherein said cylindrical sleeve completely circles the periphery of said smooth cylindrical surface.

3. The winch of claim 1 wherein said arrangement is a drum keyway.

4. The winch of claim 1 wherein said antirotation arrangement is an attachment on the side of said cylindrical sleeve attached to said mounting base.

5. The winch of claim 4 wherein said attachment includes a lug on said cylindrical sleeve that rides in a slot on said mounting base.

6. The winch of claim 1 wherein said cable inlet and said cable outlet include a flat section that lies on or just inside the tangent to said smooth cylindrical surface of said winch drum.

7. The winch of claim 1 which includes:

a cable wound on said winch;

a cable tensioner for said cable for controlling tailing tension on said cable and permitting the cable to safely slip on said winch drum if the load exceeds an amount as determined by the cable tension.

8. A winch for a cable comprising:

a winch drum having an arrangement for connecting to a source of power and a smooth cylindrical surface adapted to be in direct contact with a cable helically wound thereon;

a cylindrical sleeve surrounding said winch drum with sufficient clearance to permit said winch drum to rotate in said sleeve and fixed so as to not move a substantial amount axially relative thereto;

an inner helical groove having two ends located on the inside of said cylindrical sleeve with said groove being of a depth and width to receive a cable wound on said winch drum;

a cable inlet and a cable outlet on said cylindrical sleeve leading to the ends of said inner helical groove;

an anti-rotation arrangement to prevent said cylindrical sleeve from rotating when said winch drum is rotating;

a cable turning device connected to said mounting base for one end section of a cable;

a cable tensioner pulley for said one end section of a cable; and a tensioning device for said cable tensioner pulley for applying tension to said one end section of a cable to move said cable tensioner pulley to accommodate variations of slack in the cable and control the tailing tension on the cable wound on said winch drum whereby the cable will safely slip on said winch drum if the load exceeds an amount as determined by the cable tension.

9. The winch of claim 8 which is designed to pull both ends of a continuous cable which further includes:

a stop for limiting the amount of movement of said cable tensioner pulley when cable tension is applied thereto to pull a load rather than tail a load;

a second cable turning device for the second end section of a cable;

a second cable tensioner pulley for said second end section of a cable;

a second tensioning device for said second cable tensioner pulley for applying tension to said second end section of a cable to move said second cable tensioner pulley to accommodate variations of slack in the cable and control tailing tension on the cable wound on said winch drum whereby the cable will safely slip on said which drum if the load exceeds an amount as determined by the cable tension; and a second stop for limiting the amount of movement of said second cable tensioner pulley when cable tension is applied thereto to pull a load rather than tail a load.

* * * * *